US005462198A

United States Patent [19]

Schwimmer

[11] Patent Number: 5,462,198

[45] Date of Patent: Oct. 31, 1995

[54] MODULAR BOTTLE DISPENSER

[75] Inventor: Alan F. Schwimmer, Northbrook, Ill.

[73] Assignee: Miles Inc., Elkhart, Ind.

[21] Appl. No.: 217,485

[22] Filed: Mar. 23, 1994

[51] Int. Cl.[6] ..... B65H 3/44

[52] U.S. Cl. ..... 221/130; 221/131; 221/155; 221/194; 221/281; 221/289

[58] Field of Search ..... 221/191, 193, 221/194, 195, 251, 255, 256, 257, 281, 289, 294, 6, 66, 92, 155, 123, 124, 130, 131; 312/45; 206/45.13, 45.17, 44.12

[56] References Cited

U.S. PATENT DOCUMENTS

| | | | |
|---|---|---|---|
| 2,193,211 | 3/1940 | Taylor | 221/155 X |
| 2,852,327 | 9/1958 | Mason | 312/45 |
| 2,956,660 | 10/1960 | Nordquist | 221/281 X |
| 2,996,344 | 8/1961 | Garman | 312/45 |
| 3,141,571 | 7/1964 | Moore | 221/281 X |
| 4,243,145 | 1/1981 | Woodhead | 221/131 X |
| 4,287,992 | 9/1981 | Takemori | 312/45 X |
| 5,199,598 | 4/1993 | Sampson | 221/194 |

*Primary Examiner*—William E. Terrell
*Assistant Examiner*—Dean A. Reichard
*Attorney, Agent, or Firm*—Mary G. Boguslaski

[57] ABSTRACT

The present invention is directed to a modular bottle dispenser apparatus used for dispensing bottles. Each dispenser includes a receiver opening, a dispenser opening, a continuous guide channel which restricts the side to side and up and down motion of a bottle as it moves from the receiver opening to the dispenser opening, a friction reducing member and a door that covers the receiver opening. Several dispensers can be interlocked to each other through interlocking members provided by the dispenser. The interlocking of several dispenser allows the display of various products in one contiguous setting.

8 Claims, 3 Drawing Sheets

MODULAR BOTTLE DISPENSER

FIELD OF THE INVENTION

The present invention relates generally to a bottle dispenser apparatus used for storing, displaying and dispensing bottles. More specifically, the present invention relates to a bottle dispenser apparatus that can be interlocked with an adjacent bottle dispenser apparatus.

BACKGROUND OF THE INVENTION

Retail shelf space is a coveted commodity among manufacturers. Because the retailer must set aside shelf space on which to display a manufacturer's products, there is fierce competition for shelf space among various manufacturers of competing products. Furthermore, with the proliferation of generic "house-brands," a manufacturer must also compete for shelf space with the retailer's own competing product. For example, retailers often display several competing products, including national brands as well as house-brands, next to each other.

In the vitamin industry, manufacturers typically offer several different vitamin products aimed at meeting the special needs of different segments of the population. Various vitamin products tailored to meet the nutritional requirements of the elderly, children, men, women, and other sub-segments of the population are offered by manufacturers of the national brands as well as by the retailers themselves. Typically, a retailer displays vitamin products by their similarity. For example, a retailer offering vitamins for the elderly arranges the national brands as well as its own next to each other. The end result of displaying competing products next to each other is brand dilution. A customer is not made aware that one brand, either national or generic, offers a range of products suitable for the entire family from grandparents to infants.

One way of displaying all of the different products of one manufacturer is to place them side by side on a shelf. However, merely placing products side by side on a shelf does not prevent product commingling; the retailer or a customer can still intermix the products at will. Because customers routinely pick up products and return them to the shelves, it is not an uncommon sight to see disorganized shelves holding numerous products, sizes and brands commingled with each other. Accordingly, there is a need for dispensers which can organize a shelf and display products in an orderly manner.

U.S. Pat. No. 3,152,697 issued to Berman discloses a modular dispensing display rack in which an assembly of such racks can be made by inserting threaded bolts through the rack and screwing a nut on the bolt. A major disadvantage of Berman is that a different length bolt is required for the addition of every additional display rack. A retailer would thus need to keep on hand bolts of differing lengths. There is thus a need for dispensers which can be interlocked without using specially sized bolts and nuts.

Gravity feed bottle dispensers in which the bottles travel down an inclined ramp are known. In a typical gravity feed bottle dispenser, bottles are loaded into the dispenser through an opening at the top. The bottles then roll down several inclined ramps and are finally dispensed at the end of the final inclined ramp. Because there are typically two or more inclined ramps, the bottles must change direction by 180 degrees as they roll down the ramps. A major problem with these dispensers is that bottles jam in the inclined passages. Bottles jam in the inclined passages because the bottles's freedom for up and down motion as they travel down the inclined ramp is not restricted. Accordingly, there is a need for a gravity feed bottle dispenser that restricts a bottle's up and down motion while traveling down an inclined ramp.

Jamming is particularly problematic at the juncture where the bottle is required to turn by 180 degrees in moving from one ramp to another ramp. An attempt to ameliorate this problem was disclosed in U.S. Pat. No. 3,286,846 issued to Brandes. Brandes discloses a generally triangular turnstile at the juncture between an upper and a lower ramp. While adding a turnstile may reduce the likelihood of jamming at the juncture between an upper and a lower ramp, the turnstile does nothing to prevent jamming in the inclined passages. Furthermore, the incorporation of a movable turnstile at each and every juncture makes the manufacture of a dispenser more difficult and expensive. There is a long felt need in the art for a gravity feed bottle dispenser that greatly reduces the likelihood of jamming, particularly at the juncture between an upper and a lower ramp.

The shelf size in most retail establishments is standard, that is, the height and depth of shelves are fixed. Any dispensers used by the retailer must fit within the boundaries established by the shelf height and depth. When a retailer wishes to use a gravity feed dispenser on shelves, the dispenser cannot be too tall or too deep, otherwise the dispenser will not fit on the shelves. The practical limitation of shelf height and depth is that in a gravity feed bottle dispenser, the angle of the ramp must be large enough to allow the bottles to roll or slide down the ramp but be small enough to allow for the efficient use of the given space (i.e. more bottles per given area).

When the product in the bottle is a solid, a powder or a gelatin capsule, the bottle is usually only partially filled. Because the bottle is only partially filled, the product settles in the bottle and a greater angle is required to ensure that the bottle will travel down the inclined ramp. Accordingly there is a need for a bottle dispenser that can dispense bottles which are either fully filled or partially filled with a solid, a powder or a gelatin capsule. In addition, such a bottle dispenser must fit within the confines of the standard size shelves found in most retail establishments.

SUMMARY OF THE INVENTION

The present invention provides a modular bottle dispenser apparatus for storing, displaying and dispensing bottles. The dispenser includes a housing which includes two openings, one for receiving bottles and a second opening for dispensing bottles. The housing of the dispenser further includes an interlocking member for interlocking a modular bottle dispenser apparatus to an adjacent modular bottle dispenser apparatus. In another aspect, bottle dispensers of different sizes can be interlocked to each other.

There are several advantages in interlocking several dispensers. One advantage is that all of the different products of one manufacturer can be displayed in one contiguous setting. This creates a billboard effect in which consumers are apprised of all of the available products from one manufacturer.

In one aspect, the interlocking member is a male member or a female member. A male member of a modular bottle dispenser can be joined to a female member of an adjacent bottle dispenser. In another aspect, one side of the housing of a bottle dispenser provides a male interlocking member and the opposite side of the same bottle dispenser provides a female interlocking member. Providing interlocking members as an integral part of the dispenser allows the interlocking of as many dispensers as is required without the need for a separate bolt or a pin or the like.

In one aspect the present invention provides a modular bottle dispenser with a continuous guide channel extending between the two openings. The continuous guide channel provides a path, in which the bottles travel, from the first opening to the second opening. The width and height of the guide channel remains substantially constant throughout the length of the guide channel, including at the juncture where the bottle is required to turn by 180 degrees in moving from one inclined ramp to a second inclined ramp. The width and the height of the guide channel is slightly larger than the dimensions of the bottle to be dispensed. The dimensions of a bottle dispenser of the present invention is such that as the bottle travels down the guide channel, the bottle's freedom to move in any direction other than down the inclined ramps is severely restricted. Because the bottle is controlled by guide channel with dimensions which are substantially constant throughout the entire length of the guide channel, the likelihood of jamming is greatly reduced.

In another aspect, the continuous guide channel provides inclined ramps with an angle of about 10 degrees. Partially filled bottles, due to the settling of the contents, do not roll or slide an inclined ramp until a critical angle is reached. In our experiments bottles which were either completely full or completely empty would easily roll down an inclined ramp as shallow as one degree. An angle between about 9 degrees and about 11 degrees is particularly advantageous in that both fully filled bottles and partially filled bottles can roll or slide down such an incline.

A further aspect of the invention provides a modular bottle dispenser apparatus in which the housing provides a friction reducing member. The friction reducing member reduces the friction between a bottle and the side wall of the housing as it travels down the continuous guide channel of a bottle dispenser of the present invention. The friction reducing member is found on the inside side wall of the housing of a modular bottle dispenser of the present invention and is substantially parallel to the continuous guide channel of the bottle dispenser. The friction reducing member can be a raised ridge on the inside wall of the housing that is substantially parallel to the continuous guide channel as discussed above.

In a still further aspect, the present invention provides a modular bottle dispenser with a second opening in which the bottles are dispensed. The second opening includes a retaining lip. The retaining lip prevents bottles from rolling off the continuous guide channel and allows for easy removal of a bottle from the dispenser by a customer.

The present invention also provides a modular bottle dispenser with a door that covers the first opening. The first opening is used to load the dispenser with bottles. The door is attached through a hinge to the housing of a modular bottle dispenser of the present invention. The door is opened in order to load the dispenser with bottles. The door also provides a refill indicator. An exemplary refill indicator is an open slot in the door which allows for the visual inspection of the continuous guide channel. The refill indicator gives the retailer a quick and easy method for checking stock without having to open and close the doors of each and every bottle dispenser.

BRIEF DESCRIPTION OF THE DRAWINGS

FIG. 1 is a perspective view of a modular bottle dispenser apparatus constructed in accordance with the principles of the present invention;

FIG. 2 is a perspective view of a modular bottle dispenser apparatus illustrated in FIG. 1 with the door that covers the receiver opening used for loading the dispenser in the open position;

FIG. 3 is an enlarged cross sectional view taken along line 3—3 in FIG. 1;

FIG. 4 is a cross sectional perspective view of the internal structures of the modular bottle dispenser apparatus, including the continuous guide channel;

FIG. 5 is a partial cut away, perspective view of male interlocking member and a female interlocking member of a modular bottle dispenser apparatus;

FIG. 6 is a male interlocking member inserted into a female interlocking member of a modular bottle dispenser apparatus; and FIG. 7 is a view of male and a female interlocking members of a modular bottle dispenser apparatus in the locked position.

DESCRIPTION OF THE PREFERRED EMBODIMENTS

Figure 1:
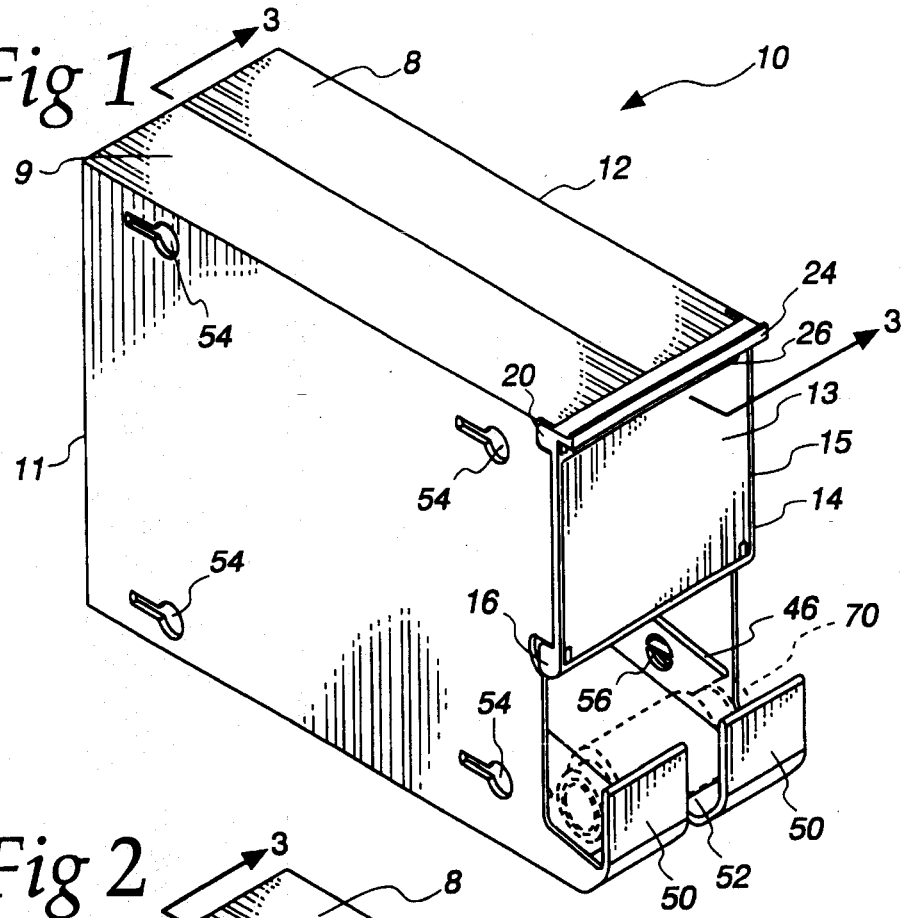
FIGS. 1–7 show seven views of a preferred embodiment of the present invention. It is understood that this invention is not limited to the particular embodiments disclosed. The structures of the present invention as disclosed can be modified or replaced without departing from the spirit or scope of the invention as defined by the claims and the specification.
Figure 2:
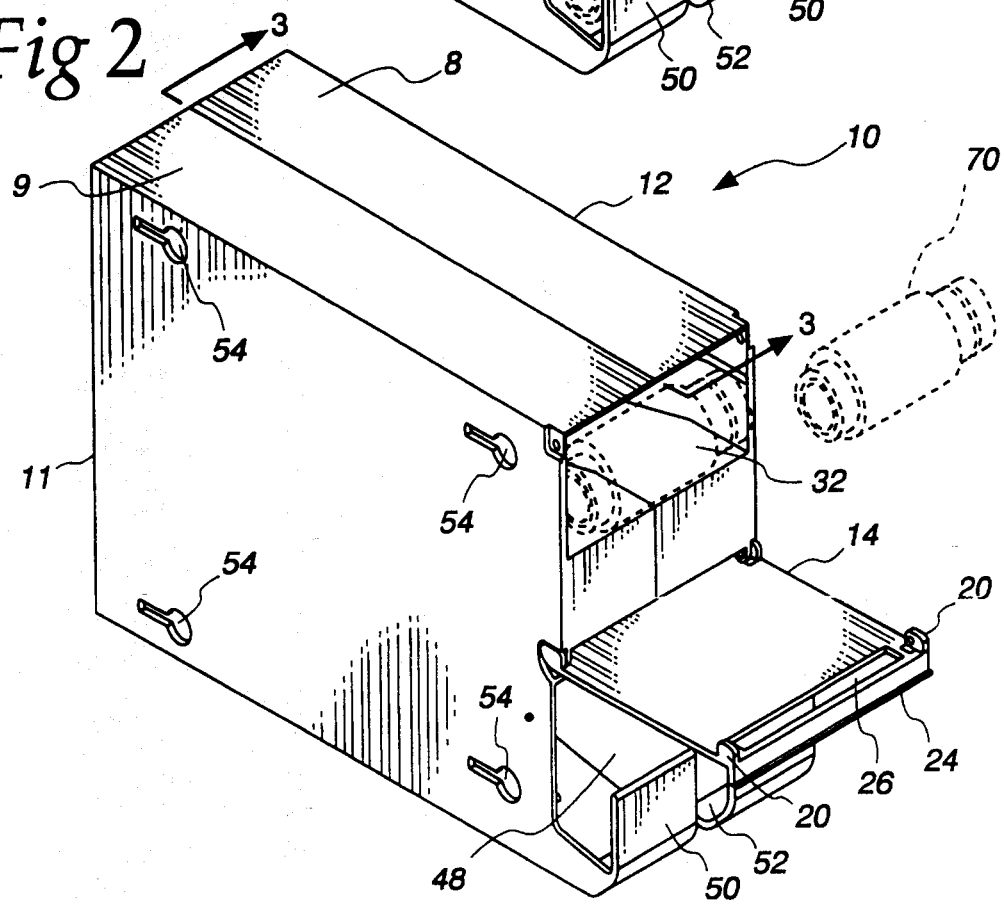

Referring now to the drawings, FIGS. 1 and 2 show a perspective view of an exemplary modular bottle dispenser apparatus 10. The modular bottle dispenser 10 of the present invention is preferably manufactured from plastic materials. The modular bottle dispenser 10 fits on a shelf of standard height available in most retail establishments and must be equal to or shorter than the height of a standard sized shelf.

The modular bottle dispenser apparatus 10 comprises a housing 12 that has side walls 11 and includes a receiver opening 32 into which the bottles are loaded into the dispenser 10. A door 14 is mounted on the housing 12 to cover the opening 32. A dispenser opening 48 that dispenses bottles is also provided by the housing 12.

Figure 4:
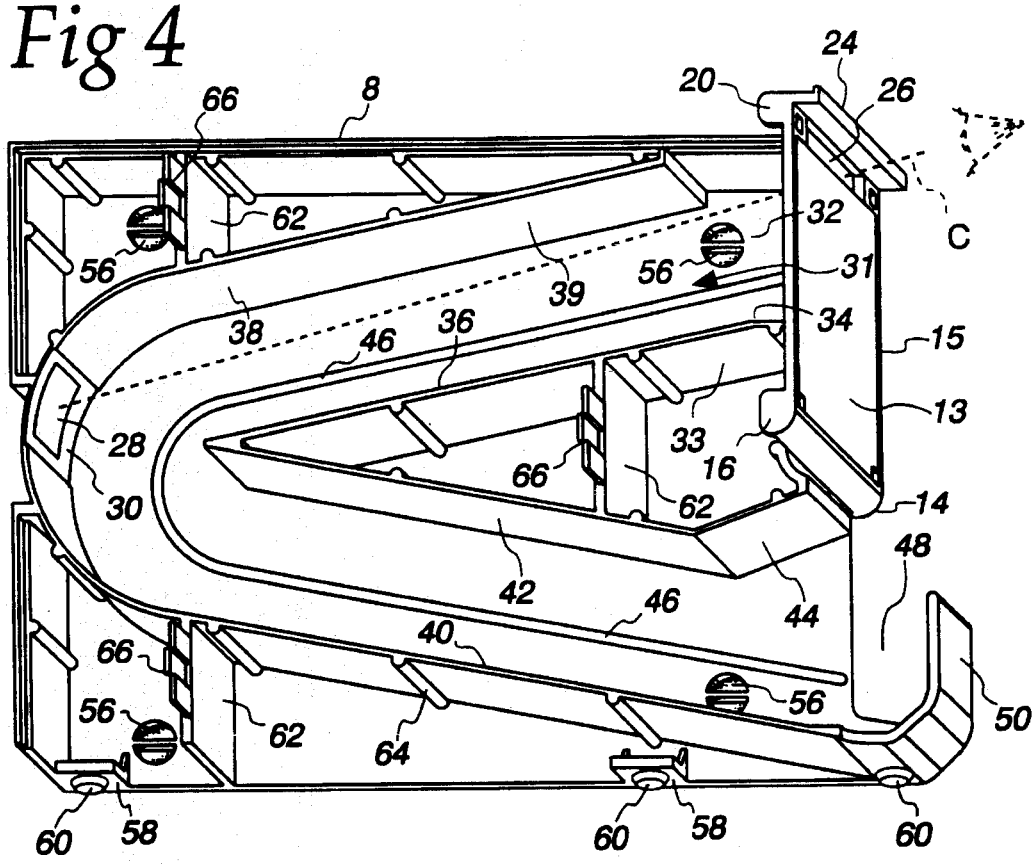

The modular bottle dispenser 10 is defined by two mirror image dispenser halves 8 and 9 which are glued together or joined in some other well known manner. As shown in FIG. 4, a dispenser half 8 provides a three tined joining member 66 that is integrally formed with a structural support member 62 formed on the dispenser half 8. The matching dispenser half 9 provides a compatible three fined joining member that can be mated to the three tined joining member 66 by the use of an adhesive or other methods. In addition to the structural support member 62, there are numerous fibs 64 formed on the two dispenser halves 8 and 9 which confer structural rigidity to a modular bottle dispenser 10. Furthermore, the housing 12 includes feet 58 onto which rubber pads 60 can be attached. Alternatively, the housing 12 can be manufactured in one contiguous piece rather than two dispenser halves.

It is desirable to interlock bottle dispensers 10 together to create a billboard effect. The billboard effect results from joining several bottle dispensers 10 together to present all of the doors 14, which each bear a label identifying the product contained in the dispenser 10, in one contiguous display. In addition each bottle dispenser 10 displays and dispenses only one product. The billboard effect is therefore created by the contiguous display of both the labels on the doors 14 and the products.

The ability to interlock several bottle dispensers 10 together allows a retailer to present all of the products of one manufacturer in one contiguous setting to a customer. This prevents commingling of different products and brands and prevents brand dilution. Furthermore displaying all of the products of one brand in one contiguous setting is advantageous in that consumers are apprised of all of the available products from one manufacturer.

Figure 5:
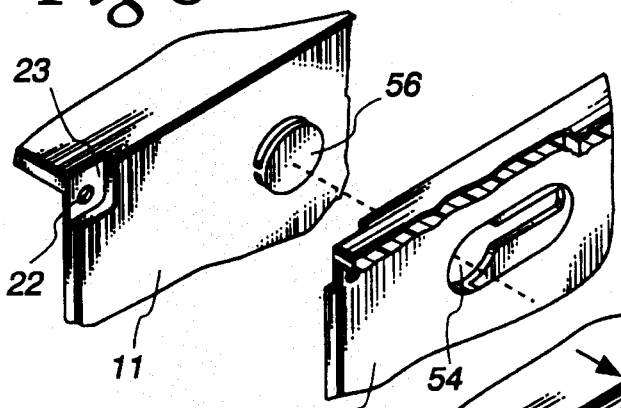
Figure 6:
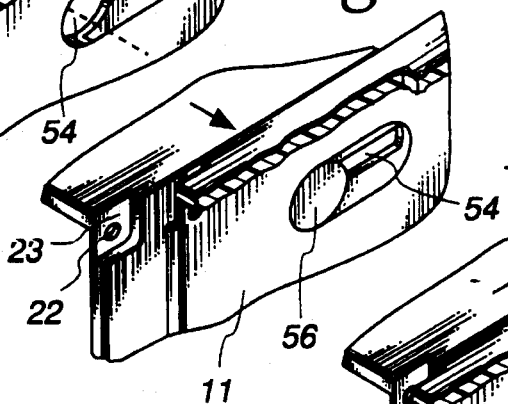
Figure 7:
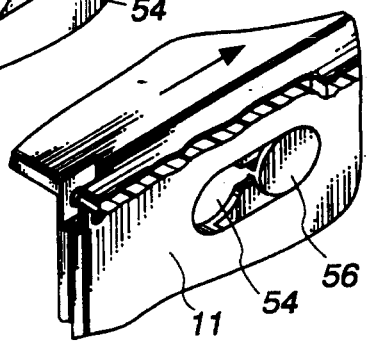

As shown in FIGS. 5–7, several modular bottle dispensers 10 can be attached together through interlocking female members 54 and male members 56 which are integrally formed with each sidewall 11 of the housing 12. The male member 56 is inserted into the keyhole shaped female member 54. The dispensers 10 are then locked together by sliding the interlocking members 54 and 56 against each other. The present invention contemplates that different size bottle dispensers designed to dispense bottles of different sizes can be interlocked. It is understood that other configurations of interlocking members are possible and that the present invention contemplates these other configurations.

The modular bottle dispenser 10 includes two openings. The receiver opening 32 receives bottles and the dispenser opening 48 dispenses these bottles. The receiver opening 32 is covered by the door 14. One advantage of covering the receiver opening 32 by a door 14 is that the bottle dispenser 10 always appears full to a customer. The customer sees only the bottle 70 in the dispenser opening 48.

A further advantage provided by a modular bottle dispenser 10 is the automatic rotation of stock. Rotation of stock usually requires the retailer to manually manipulate the bottles on the shelf to bring the older stock to the front. As customers purchase bottles, newer stock must be continually moved to the back of the shelf. The bottle dispenser 10 of the present invention provides for the automatic rotation of stock by causing the first bottle 70 that is inserted into the receiver opening 32 to be the first bottle to be dispensed by the dispenser opening 48.

Figure 3:
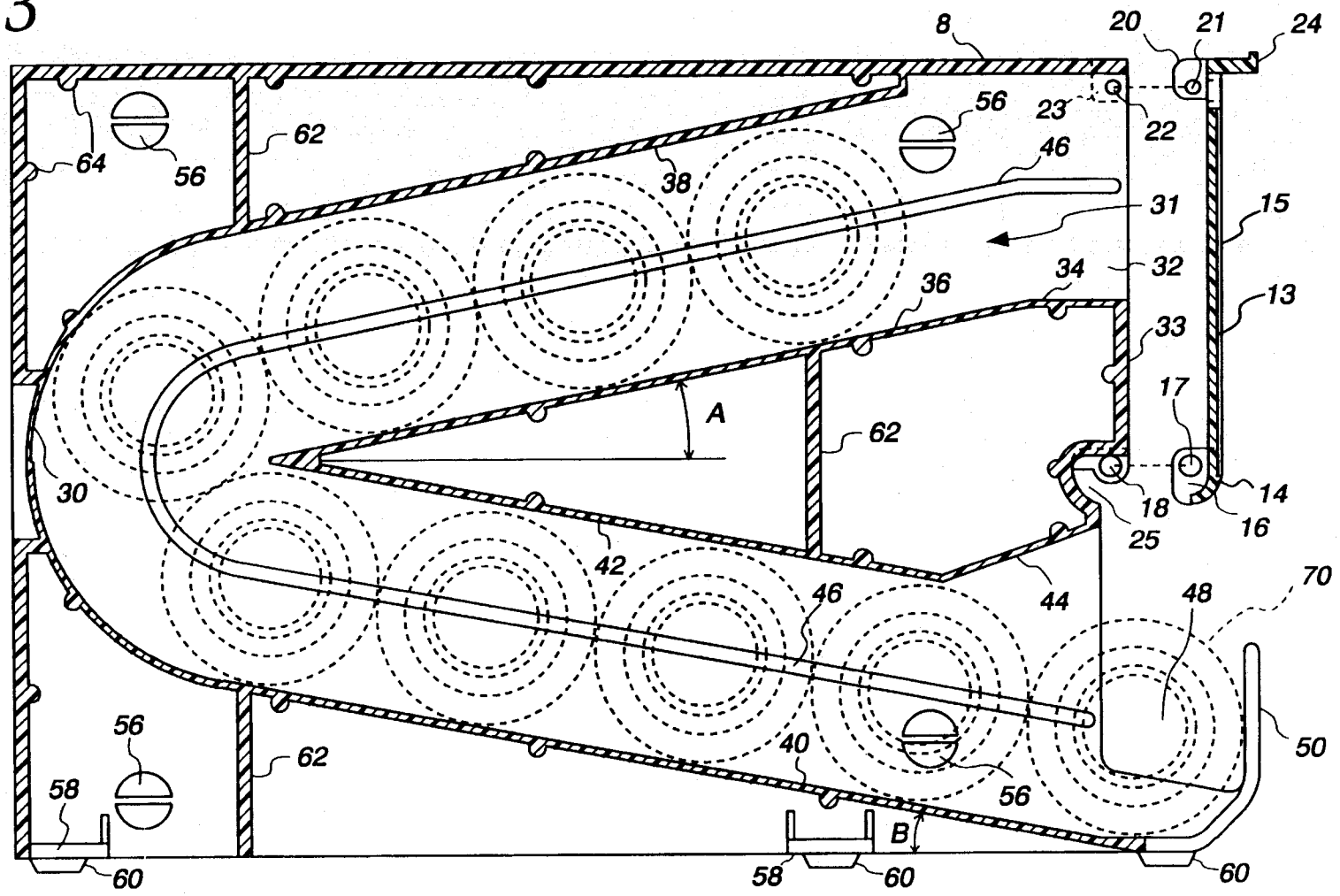

The Door 14 can be opened and closed by using a door handle 24. As shown in FIG. 3, the door 14 is attached by a hinge 16 to a V-shaped guide island 33 that is formed integrally with the side wall 11. The hinge 16 includes a raised dimple 17 which fits into a hinge hole 18 formed in the V-shaped guide island 33. In the open position, the hinge 16 fits into a recess 25 in the V-shaped guide island 33. In the closed position, the door 14 locks through a fastener 20 into a notch 23 provided by the housing 12. The fastener 20 has a raised dimple 21 which snaps into a door locking hole 22 located in notch 23. A detailed view of the door locking hole 22 and notch 23 is shown in FIG. 5. The notch 23 is inset into the side wall 11 of the housing 12 and allows doors 14 from adjacent dispensers to lock without interfering with each other when two or more bottle dispensers 10 are interlocked (FIG. 7).

The door 14 further provides a refill indicator 26 that allows the retailer to determine if a bottle dispenser 10 requires refilling without opening the door 14 of the dispenser. When a bank of dispensers is utilized, the retailer can check every dispenser without having to open a single door. The door 14 of a dispenser 10 is opened only when a dispenser requires refilling. In one embodiment, the refill indicator 26 is a rectangular opening in the door 14. The dotted line 27 in FIG. 4 illustrates a visual line C leading to a label 28 with a "restock now" or similar message. The label 28 is placed in a slight indentation 30 of a curvilinear guide surface 38. The indentation 30 ensures that the label 28 will not interfere with a bottle 70 as it travels from the receiver opening 32 to the dispenser opening 48.

A label also can be attached to the door 14. Door 14 includes a raised ridge 15 which creates a recess 13 into which a label can fit. A label discloses to a customer the product contained in a particular dispenser 10. A label can be attached to door 14 through the use of an adhesive or through other means. A customer can thus find the identity of the product in a dispenser from two sources: (1) the label on the door, and (2) the product itself displayed in the dispenser opening 48. When many dispensers are interlocked together to form a bank of dispensers, the labels on each door and the displayed products create a billboard effect that apprises the customer of all of the products from one manufacturer.

The modular bottle dispenser 10 of the present invention provides a continuous guide channel 31 which restricts the side to side and up and down movement of a bottle 70 as it travels from the receiver opening 32 to the dispenser opening 48. Because the freedom of the bottle 70 to move side to side or up and down is severely restricted by the dimensions of the continuous guide channel 31, there is little likelihood of bottles jamming as they travel from the receiver opening 32 to the dispenser opening 48.

As a bottle 70 travels down the continuous guide channel 31, it travels first on an upper inclined ramp 36 of the V-shaped guide island 33. Next, the bottle travels on a lower inclined ramp 40 of the curvilinear guide surface 38. In one embodiment, the V-shaped guide island 33 includes an upper inclined ramp 36 with an angle (A) of about 10 degrees and a lower inclined ramp 40 with an angle (B) of about 10 degrees. An incline of about 10 degrees is the minimum angle that allows partially filled bottles to roll or slide an inclined ramp. An incline of about 10 degrees is advantageous in that both fully filled bottles and partially filled bottles can roll or slide down such an incline without the need for a structure such as a turnstile as required by prior art.

The V-shaped guide island 33 further includes a horizontal shelf 34 which allows the height of a dispenser 10 to be equal to or shorter than the height of a standard shelf while still maintaining an angle of about 10 degrees for the upper inclined ramp 36 and lower inclined ramp 40. Without the horizontal shelf 34, the upper inclined ramp 36 would extend out further towards the door 14 which would result in an increased height for the dispenser 10.

The continuous guide channel 31 of a modular bottle dispenser 10 is formed by the side wall 11 of the housing 12, the curvilinear guide surface 38, and the generally V-shaped guide island 33. The curvilinear guide surface 38 and the generally V-shaped guide island 33 are integrally formed with the housing 12 and extend from each side wall 11. The curvilinear guide surface 38 includes an upper guide surface 39 and a lower inclined ramp 40. The V-shaped guide island includes an upper inclined ramp 36 and an upper guide surface 42. As a bottle 70 moves down the continuous guide channel 31, the bottle's side to side motion is restricted by each side wall 11 of the housing 12. Similarly, the bottle's up and down motion is restricted by either the upper guide surface 39 when the bottle is on the upper inclined ramp 36, or when the bottle is on the lower inclined ramp 40 the up and down motion is restricted by the upper guide surface 42 of the V-shaped guide island 33. The tight control of the bottles motion exerted by the continuous guide surface 38 and the V-shaped guide island 33 reduces the likelihood of bottles jamming in the bottle dispenser 10.

The travel of a bottle down the continuous guide channel 31 is further enhanced by a friction reducing member 46 provided on the side wall 11 of the housing 12 of a modular bottle dispenser 10. The friction reducing member is a raised ridge 46 which reduces the surface area of the side wall with which a bottle 70 comes into contact while it travels from the receiver opening 32 to the dispenser opening 48.

The dispenser opening 48 allows bottles to be displayed and allows for easy retrieval by a customer. As shown in FIG. 3, the dispenser opening 48 is formed by an angled surface 44 of the V-shaped guide island 33 and the retaining lip 50. The bottles 70 rest against the retaining lip 50 and the angled surface 44 provides a large opening to allow easier grasping of the bottle 70. The ease of retrieving a bottle 70 is further enhanced by the notch 52 in the retaining lip 50. The notch 52 provides a space in which to insert a finger or a thumb to grasp a bottle 70.

The bottle dispenser 10 of the present invention stores, displays and dispenses difficult to roll bottles in the space provided by a standard size retail shelf. Further, several bottle dispensers 10 can be interlocked with the use of interlocking members which create a visual billboard effect. In addition, a bottle dispenser 10 always appears full to a customer but can be checked by visual inspection to determine if the dispenser 10 requires restocking.

What is claimed is:

1. A modular bottle dispenser apparatus for storing, displaying and dispensing bottles comprising:

a. a housing which includes a first opening for receiving bottles and a second opening for dispensing said bottles, said housing further including side walls, each said side wall including a friction reducing member, each said side wall further including members for interlocking adjacent modular bottle dispenser apparatuses; and b. a continuous guide channel of two guide surfaces extending between said first opening and said second opening, said two guide surfaces defined by an upper inclined ramp and a lower inclined ramp, said upper inclined ramp being adjacent said first opening, a portion of said upper inclined ramp adjacent said first opening being horizontal, wherein the two guide surfaces are parallel over a substantial portion of the guide channel and the distance between the two guide surfaces is substantially constant over the length of the continuous guide channel, said continuous guide channel further defined as providing a path with an incline between about 9 degrees and about 11 degrees, in which said bottles travel from said first opening to said second opening.

2. The modular bottle dispenser apparatus of claim 1, wherein said interlocking members are further defined as including a male interlocking member and a female interlocking member.

3. The modular bottle dispenser apparatus of claim 2, wherein said male interlocking member of a modular bottle dispenser apparatus can be joined to said female interlocking member of an adjacent modular bottle dispenser apparatus.

4. The modular bottle dispenser apparatus of claim 3, wherein said male interlocking member or said female interlocking member is integrally formed with said side walls of said housing.

5. The modular bottle dispenser apparatus of claim 1, wherein said friction reducing member is further defined as a raised ridge that is substantially parallel to said continuous guide channel.

6. The modular bottle dispenser apparatus of claim 1, wherein said dispenser further includes a door hingedly attached to said housing that covers said first opening for receiving said bottles.

7. The modular bottle dispenser apparatus of claim 1, wherein said dispenser further includes a door, hingedly attached to said housing that covers said first opening for receiving said bottles, said door further including a refill indicator, wherein said refill indicator is an open slot on said door.

8. The modular bottle dispenser apparatus of claim 1, wherein said second opening for dispensing said bottles further includes a retaining lip.

* * * * *